United States Patent [19]

Krieg

[11] Patent Number: 4,605,994

[45] Date of Patent: Aug. 12, 1986

[54] FLASH LAMP

[75] Inventor: Rudolf Krieg, Munich, Fed. Rep. of Germany

[73] Assignee: Patent-Treuhand-Gesellschaft für elektrische Glühlampen mbH, Munich, Fed. Rep. of Germany

[21] Appl. No.: 717,702

[22] Filed: Mar. 29, 1985

[30] Foreign Application Priority Data

Apr. 3, 1984 [DE] Fed. Rep. of Germany ..... 3412476

[51] Int. Cl.[4] ..... F21L 7/00

[52] U.S. Cl. ..... 362/202; 362/205; 362/187

[58] Field of Search ..... 362/202, 187, 203, 204, 362/205, 191, 196, 208, 306

[56] References Cited

U.S. PATENT DOCUMENTS

| | | | |
|---|---|---|---|
| 2,338,078 | 12/1943 | Wood | 326/187 |
| 2,361,480 | 10/1944 | Joffo | 362/205 |
| 2,855,499 | 10/1958 | Lewis | 362/202 |
| 4,398,238 | 8/1983 | Nelson | 362/202 |

FOREIGN PATENT DOCUMENTS

| | | | |
|---|---|---|---|
| 639631 | 4/1935 | Fed. Rep. of Germany | 362/202 |

*Primary Examiner*—James C. Yeung

*Attorney, Agent, or Firm*—Frishauf, Holtz, Goodman & Woodward

[57] ABSTRACT

To efficiently utilize a halogen incandescent lamp in a flashlight, while providing for essentially uniform illumination of respective spot and flood fields, the halogen incandescent lamp (11) is located within an elliptical reflector portion (12), with the filament of the lamp at one of the focal points of the ellipse. A part spherical reflector portion (13) is joined to the elliptical portion (12). At or close to the second focal point of the ellipse, a diaphragm (14) is located, which diaphragm is imaged by a condenser lens (16). The change between spot and flood illumination is obtained by varying the diaphragm opening, for example by a variable diaphragm size opening, or shifting the diaphragm towards and away from the first focal point.

9 Claims, 3 Drawing Figures

FLASH LAMP

Reference to related application, assigned to the assignee of the present application, the disclosure of which is hereby incorporated by reference:

U.S. application Ser. No. 717,706, filed Mar. 29, 1985.

The present invention relates to a flash lamp, and more particularly to a flash lamp using a miniature halogen incandescent lamp as the light source, the flash lamp including a reflector and a lens system that is particularly adapted to provide, respectively, spot and flood illumination, as desired.

BACKGROUND

The advance in manufacturing technology relating to halogen incandescent lamps makes it possible to equip hand-held flashlights and the like, supplied from primary or rechargeable batteries. By use of halogen incandescent lamps as the light source, about four times as much light can be obtained than that derived from standard miniature incandescent lamps. Consequently, a substantially brighter light can be obtained. Halogen incandescent lamps, however, when placed into standard flashlights, have a beam path which may not be suitable for optimum utilization. Usually, such flashlights have a simple reflection system including a parabolic reflector; no lenses or diaphragms are usually provided. Upon changing the position of the reflector with respect to the lamp, light cones of different aperture angle can be obtained. Unfortunately, the intensity of illumination across the light cone is highly variable and, frequently, just in the center of the illuminated area, a "black hole" appears, with a minimum of illumination being available from the central region.

Use of halogen incandescent lamps, entirely apart from the higher brightness obtainable for an illuminated region, opens a new field of utility for flashlights. Flashlights with halogen incandescent lamps can be used for signalling over substantial distances, due to their brightness; further, upon properly placing the halogen incandescent lamp in an optical system, precise spot illumination can be obtained, and the spot illumination used, for example, to trace outlines, to be used as a lightmarker in connection with optical presentations or to decode symbols. Such use, however, requires that the light beam or light cone which is generated have a very low cone angle with a sharp transition or boundary zone. Ordinary flashlights or flash lamps do not permit such use.

THE INVENTION

It is an object to provide a flashlight which, selectively, provides for bright, essentially uniform illumination of an illuminated area, while, additionally, permitting the formation of sharp light beams for spot illumination of narrow regions, with high intensity, and low light diffusion.

Briefly, the flashlight has the usual features of a housing, a compartment to receive batteries, electrical connections, an ON/OFF switch to connect a halogen incandescent lamp to the battery and the like. In accordance with the present invention, the flashlight has the additional features of an elliptical reflector portion, within which the halogen incandescent lamp is located; the elliptical reflector portion merges, in the direction of emanation of the light beam—with an approximately part spherical reflector portion, having its largest opening facing the elliptical reflector portion. Further downstream—in the direction of emanation of the light beam—and spaced from the elliptical and part spherical reflector portion, an aspherical lens is located and, between the lens and the part spherical reflector portion, a diaphragm is positioned.

Light beams emitted from the halogen lamp are reflected by the elliptical reflector portion into the second focal point of the theoretical ellipse which is formed by the elliptical reflector portion. The part spherical reflector portion picks up those light beams which were not reflected by the elliptical reflector portion, for example due to the nonpuctiform shape of the filament, that is, the light source, or due to misalignments, miscollimation and the like, and are reflected back into the elliptical reflector portion. The part spherical reflector portion thus effectively prevents loss of light energy, or light flux.

The aspherical lens effectively prevents erroneous imaging of the diaphragm, which might result by the frequently used biconvex lens. The diaphragm provides for sharp limitation of the light beam which is projected from the flashlight. The overall system formed by the reflector and the lens generates a light beam which has a sharp light-darkness transitional boundary zone, and provides essentially uniform illumination over the entire illuminated area.

In accordance with a preferred feature of the invention, the flashlight has an opaque diaphragm with a changeable diaphragm opening located at the position of the second focal point of the theoretical ellipse defined by the elliptical reflector portion, that is, downstream of the part spherical reflector portion. By increasing or decreasing, respectively, the diaphragm opening, it is possible to change the exit cone angle of the light beam and thus to increase or decrease, respectively, the illuminated area—in other words to change between flood and spot illumination.

Rather than using a diaphragm which is fixed in location within the flashlight, as explained preferably at the second focal point of the theoretical ellipse, it is possible to utilize an opaque diaphragm opening with a fixed opening dimension which, however, is slideable along the longitudinal axis of the lens/ reflector system. This arrangement also permits generation of exit openings from the flashlight or light beams of different cone angles; the light/darkness transition is not as sharp as that when using a diaphragm which is fixed at the second theoretical focal point, but of variable opening.

The diaphragm, and particularly when of a fixed size (and hence cheaper than of variable opening size) but longitudinally slideable, may also be made of a transparent plastic in which the diaphragm opening is defined by an opaque coating, in the form of an opaque ring applied to the transparent plastic diaphragm. The marginal region of the transparent plastic diaphragm may be left transparent. A diaphragm of that type can be used to obtain spot-like illumination with sharp dark-like transition, as well as flood illumination, with a continuous decrease of illumination intensity towards the outer illuminated region. A sharp definition of the illuminated area is obtained if the light beam, generated by the reflector, only meets the transparent center hole of the diaphragm and, possibly, a portion of the opaque ring. Upon suitable axial shift of the diaphragm along the optical axis, the light beam may also reach the transparent plastic material outside of the opaque ring and, thus, the region beyond the center spot will also receive light and will be illuminated, although to a lesser extent.

A merger of the light flux will take place, and the actual illuminated field distribution which is seen will change from a bright center to darker outer regions.

In accordance with a preferred feature of the invention, the part spherical reflector portion is fixedly connected with the elliptical reflector portion, thereby preventing loss of any light flux.

The elliptical reflector portion, the part spherical reflector portion, the aspherical lens and the diaphragm are preferably secured at their edges with a head portion, for example of generally cylindrical form, and surrounding the respective elements. The way of attachment depends on the size and shape of the respective elements, as well as on the materials used. A cylindrical structure is particularly suitable to receive the reflector and lens system.

DRAWINGS

DETAILED DESCRIPTION

Figure 1:
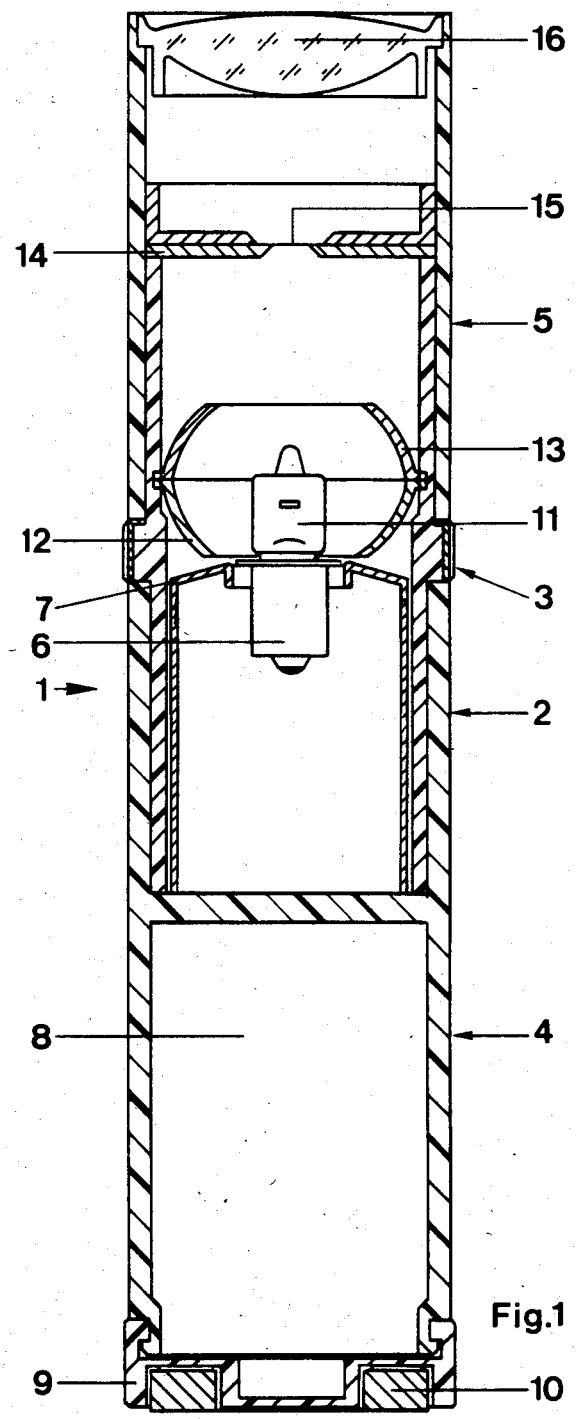
FIG. 1 is a longitudinal sectional view through a flashlight in accordance with the present invention.

The flashlight 1 has a cylindrical housing 2 made of a suitable material, as shown in FIG. 1, of plastic. A suitable dimension is an overall length of about 18 cm, and an outer diameter of about 4 cm. A metal ring 3 subdivides the housing 2 into a head portion 5, which is rotable with respect to a bottom portion 4 of the body of the flashlight. The bottom portion 4 has a lamp socket 6 thereon, which is secured to a holder 7, connecting the lamp socket 6 and the holder 7 to the base portion 4, the socket 6 being located at the end of the base portion 4 facing the head portion 5. A chamber 8 is provided within the base portion 4 to receive primary, or reachargeable batteries, for example four batteries, each of which have a dimension of 4.9 cm high by 1.3 cm diameter. A cover 9, for example screw, or bayonnet connected, closes off the chamber 8. Preferably, the cover 9 has a recess at the outer surface to receive a ring magnet 10 so that the flashlight can be retained on a ferromagnetic surface, for example against the body portion of a vehicle.

A halogen incandescent lamp 11 is fitted into the socket 6. The halogen incandescent lamp has its bulb portion located within an elliptical reflector 12. The elliptical reflector has an outer wider diameter of about 3 cm. The elliptical reflector is located in the lower part of the head portion 5. The elliptical reflector 12 is securely connected with a part spherical reflector portion 13, having a radius of curvature of 1.5 cm. The elliptical reflector 12 is so located that the filament of the halogen incandescent lamp 11 is at one focal point thereof. The elliptical reflector defines a theoretical ellipse, the second focal point of which is located at a diaphragm opening 15 of a diaphragm 14. The size of the diaphragm opening 15 is adjustable. The head portion 5 of the lamp is closed off by an aspherical condenser lens 16, having a focal length of 29 mm.

Electrical connections, switches and the like, and connection springs for the batteries have been omitted from the drawing for clarity, since they can be placed in accordance with any well-known and suitable arrangement. The switch, preferably, is a rotary switch, and upon rotation of the head portion 5, the halogen incandescent lamp 11 is energized over suitable switch terminals (not shown). Upon energization, and further rotation, the diaphragm opening is likewise changed. Preferably, the rotational positions are defined by positioning notches, or engagement grooves, having three fixed positions, generating different light beams of different diameter. In a first position, for spot illumination, the diaphragm opening 15 will be about 2.5 mm, and the light beam will provide a light output which, in 15 m distance from the flashlight will provide a uniform illumination across an image area of about 1 m diameter. In a second position, "flood I", the diaphragm opening is changed to 5 mm, and at the same distance of 15 m from the flashlight, the light cone will now illuminate a diameter of about 2.5 m. In a third position, "flood II", the diaphragm opening will be changed to 12 mm, and the illuminated area will have a diameter of 5 m at a distance of 15 m from the flashlight.

Figure 2:
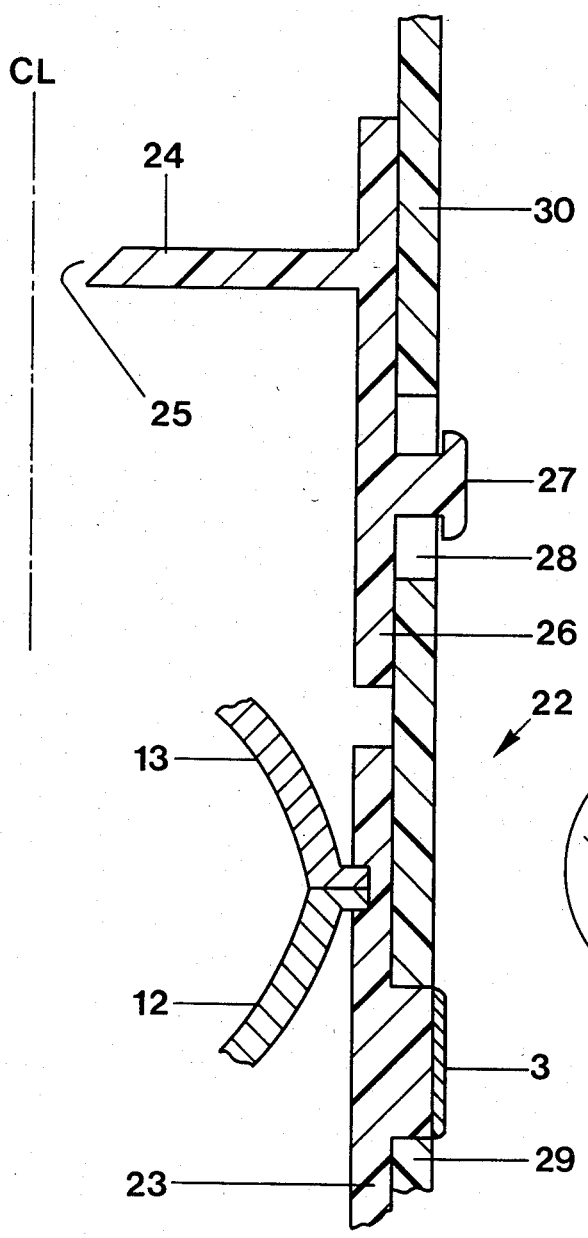
FIG. 2 is a fragmentary sectional view through one side only of the flash lamp in the region of the head portion, and showing an axially slideable arrangement.

FIG. 2 shows an alternative arrangement in which the flash lamp housing 22 has a rotable head portion 30 and a bottom portion 29. All parts are made of plastic. An inner sleeve 23 is provided to hold the reflectors 12,13 in position within the head portion 30. The socket 6 and the holder 7 for the halogen incandescent lamp 11 in the bottom portion 29 have been omitted from FIG. 2 for c1arity. The diaphragm 24 has a fixed diaphragm opening 25 and is located on an axially slideable sleeve 26, which has at least on one side a projecting button 27 fitting into a suitable slit 28 of the head portion 30 of the housing 22. In a center position, the diaphragm 24 is located at the second focal point of the theoretical ellipse. The diaphragm 24 can be shifted away from and towards the first focal point upon sliding the button 27, and with it the sleeve 26.

Figure 3:
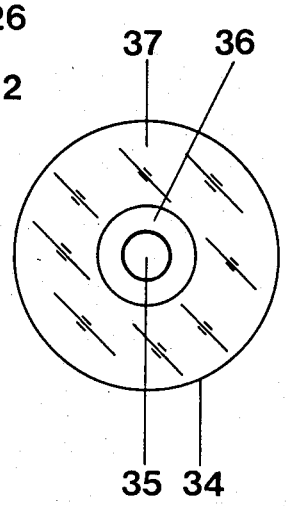
FIG. 3 is a schematic top view of a fixed diaphragm with an opaque ring.

FIG. 3 shows another embodiment, in which the diaphragm 34 is made of transparent plastic, having an outer transparent zone 37, an opaque ring zone 36 and a central transparent spot zone 35. The diaphragm 34 can be placed in the arrangement of FIG. 2 in lieu of the diaphragm 24. The parts 3, 4, 5 and 23, 26, 29 dnd 30 are held together by suitable projections, e.g., rings, ribs, or tracks and grooves; if made of metal, some of the parts may be soldered; if made of plastic, they can be connected by plastic cement. Additional holding sleeves and the like have been omitted from the drawing for clarity and can be used as desired, in accordance with well-known flashlight construction.

I claim:

1. Flashlight (1) having a housing (2) defining a battery chamber (8);

a halogen incandescent lamp (11) located and retained within the housing;

and a reflector-and-lens system secured to the housing, for projecting light from the halogen incandescent lamp, said reflector-and-lens system comprising, in accordance with the invention:

a first reflector section formed by an elliptical reflector portion (12) defining a theoretical ellipse, said reflector partly surrounding the halogen incandescent lamp (11), the filament of the halogen incandescent lamp being located at one focal point of said theoretical ellipse;

a second reflector section formed by a part spherical reflector portion (13), the wide opening of which faces the elliptical reflector portion (12) and located downstream—in the direction of the light beam from the halogen incandescent lamp (11)—adjacent the elliptical reflector portion;

a spherical condenser lens (16) spaced, downstream, from the elliptical reflector portion and the part spherical reflector portion;

and a diaphragm (14) located between the part spherical reflector portion and the aspherical condenser lens (16).

2. Flash lamp according to claim 1, wherein the diaphragm is formed with an opening (15) which is located at approximately the second focal point of the theoretical ellipse.

3. Flash lamp according to claim 2, wherein the diaphragm (14) has a diaphragm opening (15) which is variable.

4. Flash lamp according to claim 1, further including means (26, 27) for shifting the diaphragm (24) along the path of the beam of light from the halogen incandescent lamp (11).

5. Flash lamp according to claim 4, wherein the diaphragm comprises a transparent element (34) having an opaque ring zone (36) thereon, leaving a central transparent spot (35).

6. Flash lamp according to claim 1, wherein the diaphragm (24) is located at approximately the second focal point of the theoretical ellipse, and further including means (26, 27) for axially shifting the diaphragm in either direction for a limited distance away from said second focal point.

7. Flash lamp according to claim 1, wherein the part spherical reflector portion (13) and the elliptical reflector portion (12) are securely joined together.

8. Flash lamp according to claim 1, wherein the housing comprises a head portion (5);

and the elliptical reflector portion (12), the part spherical reflector portion (13), the diaphragm (14), and the aspherical condenser lens (16) are formed with edge zones, and said edge zones are secured to said head portion (5).

9. Flash lamp according to claim 8, wherein said head portion (5) is essentially cylindrical and hollow, and said edge zones are secured to the interior of the hollow cylindrical head portion.

* * * * *